US005996370A

United States Patent [19]

Lee

[11] Patent Number: 5,996,370

[45] Date of Patent: Dec. 7, 1999

[54] REFRIGERATION COMPARTMENT DOOR FOR REFRIGERATORS

[75] Inventor: Hyung G. Lee, Kyungnam, Rep. of Korea

[73] Assignee: LG Electronics, Inc., Seoul, Rep. of Korea

[21] Appl. No.: 09/094,486

[22] Filed: Jun. 10, 1998

[30] Foreign Application Priority Data

Jun. 13, 1997 [KR] Rep. of Korea ..... 97-14151
Jun. 16, 1997 [KR] Rep. of Korea ..... 97-24865

[51] Int. Cl.[6] ..... F25D 17/08

[52] U.S. Cl. ..... 62/407; 62/418; 62/DIG. 13

[58] Field of Search ..... 62/407, 413, 414, 62/417, 418, 419, 426, DIG. 13

[56] References Cited

U.S. PATENT DOCUMENTS 2,595,874 5/1952 Nason ..... 62/DIG. 13
2,758,449 8/1956 Wallenbrock ..... 62/418
5,584,191 12/1996 Kwon ..... 62/407 X
5,722,252 3/1998 Kang et al. ..... 62/418 X

*Primary Examiner*—Harry B. Tanner

[57] ABSTRACT

A refrigeration compartment door for refrigerators, provided with a door duct capable of introducing cool air to the interior of a refrigeration compartment, is disclosed. The door includes a main body having an insulating layer therein and a door duct provided in the insulating layer. Also, the door duct has at least two more branch ducts, so cool air, introduced from a cabinet of a refrigerator to the door duct, is separately introduced into the branch ducts. An insulating member is mounted to the door duct and has a plurality of first discharging holes in order to allow the cool air to be discharged into the interior of the refrigeration compartment passing through the door duct. Thus, a wide temperature difference between the interior of the refrigeration compartment and the door duct is reduced by the insulating member.

4 Claims, 6 Drawing Sheets

REFRIGERATION COMPARTMENT DOOR FOR REFRIGERATORS

BACKGROUND OF THE INVENTION

1. Field of the Invention

The present invention relates, in general, to a refrigerator and, more particularly, to a refrigeration compartment door for refrigerators provided with a door duct capable of introducing cool air to the interior of a refrigeration compartment.

2. Description of the Prior Art

As well known to those skilled in the art, a refrigerator is used for preserving food and drink at cool temperatures for a lengthy period of time. Thus, cool air is distributed to all sides of the refrigerator, thereby uniforming the inner temperature of the refrigerator. However, it is difficult to achieve an accurate supply of cool air according to a temperature deviation in the refrigeration compartment.

Particularly, a cool air duct, designed for guiding the cool air, is mounted at the rear portion of a refrigeration compartment. Also, when the door of the refrigerator is repeatedly opened and closed, hot air is unexpectedly introduced from the refrigerator's surroundings into the refrigeration compartment. As a result, the temperature of the rear portion is lower then that of the front portion of the refrigeration compartment.

Therefore, a device, provided with a configuration capable of uniforming the inner temperature of the refrigeration compartment, has been proposed. An example of a typical device is proposed by the inventors of this invention. That is, the above device is provided with a configuration capable of introducing cool air from a refrigeration compartment door to the rear portion of a refrigeration compartment.

FIGS. 1 and 2 are views illustrating the construction of a typical refrigeration compartment door for refrigerators.

As shown in the drawings, a main body 1 of the refrigeration compartment door comprises a steel plate (not shown), insulating layer 2 and door liner 3. That is, the steel plate is mounted on the front portion of the door, while the door liner 3 is provided in the interior of the door. Also, a door duct 4 is provided in the interior of the insulating layer 2.

Thus, cool air is introduced to an inlet 5 of the door duct 4 passing through a guide duct provided in the cabinet of the refrigerator. Thereafter, the cool air is discharged into the interior of the refrigeration compartment through a plurality of discharging holes 6 which are formed at the front portion of the door duct 4.

However, the problems of the typical refrigerator are described below.

First, since the front surface of the door duct 4, provided with the discharging holes 6, is directly exposed to the interior of the refrigeration compartment, there is a wide temperature difference between cool air, discharged from the door duct 4, and cool air which is formed around the front portion of the refrigeration compartment. As a result, dewdrops are easily formed at the discharging holes 6 of the door duct 4.

Second, the amount and discharging range of the cool air, passing through the discharging holes 6, are limited because one door duct 4 is provided in the door.

Third, it is difficult to mount the door liner 3 to the door when the door duct 4 is mounted, thus causing any leakage to be easily generated at the door liner 3.

SUMMARY OF THE INVENTION

Accordingly, the present invention has been made keeping in mind the above problems occurring in the prior art, and an object of the present invention is to provide a refrigeration compartment door for refrigerators capable of preventing dewdrops from being formed at a door duct.

Another object of this invention is to provide a refrigeration compartment door for refrigerators capable of sufficiently supplying cool air from the door to the rear portion of a refrigeration compartment.

A further object of this invention is to provide a refrigeration compartment door for refrigerators capable of allowing the fabrication of the door to be correctly and easily carried out.

In order to accomplish the above objects, the present invention provides a refrigeration compartment door for refrigerators, comprising: a main body including an insulating layer therein; a door duct provided in the insulating layer and having at least two more branch ducts, so cool air, introduced from a cabinet of a refrigerator to the door duct, is separately introduced into the branch ducts; and an insulating member mounted to the door duct and having a plurality of first discharging holes in order to allow the cool air to be discharged into the interior of the refrigeration compartment passing through the door duct, so a wide temperature difference between the interior of the refrigeration compartment and the door duct is reduced by the insulating member.

In the refrigeration compartment door, a basket, having a plurality of second discharging holes, is provided at a front portion of the door duct in such a manner that the second discharging holes are communicated with the first discharging holes of the insulating member.

In addition, a plurality of discharging tubes are protrudently formed on said door duct, so the cool air, passing through the first discharging holes of the insulating member, is discharged into the interior of the refrigeration compartment through the discharging tubes.

Furthermore, a front panel, having a plurality of third discharging holes, is mounted to a front portion of the door duct in such a manner that the discharging tubes are inserted into the third discharging holes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
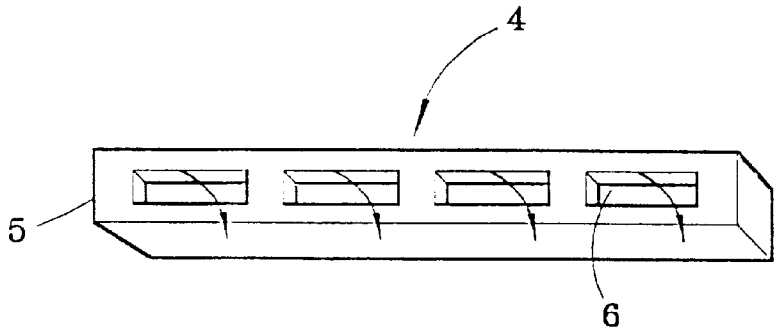
FIG. 1 is a perspective view illustrating a door duct of a typical refrigeration compartment door.
Figure 2:
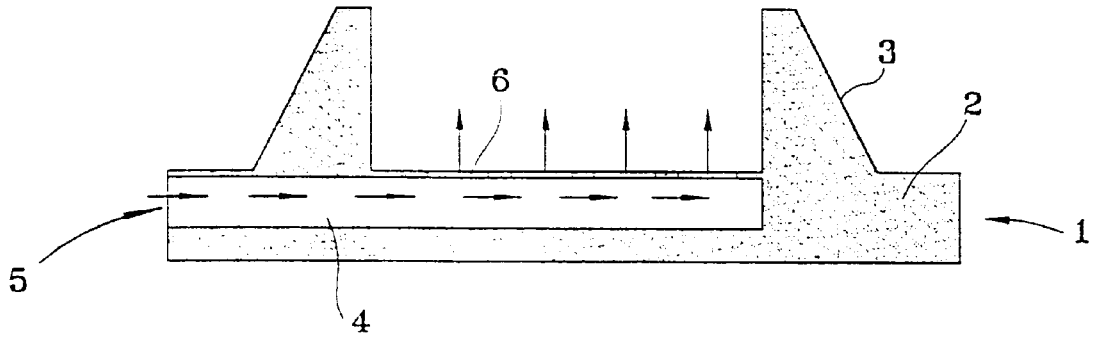
FIG. 2 is a sectional side view showing the typical refrigeration compartment door.
Figure 3:
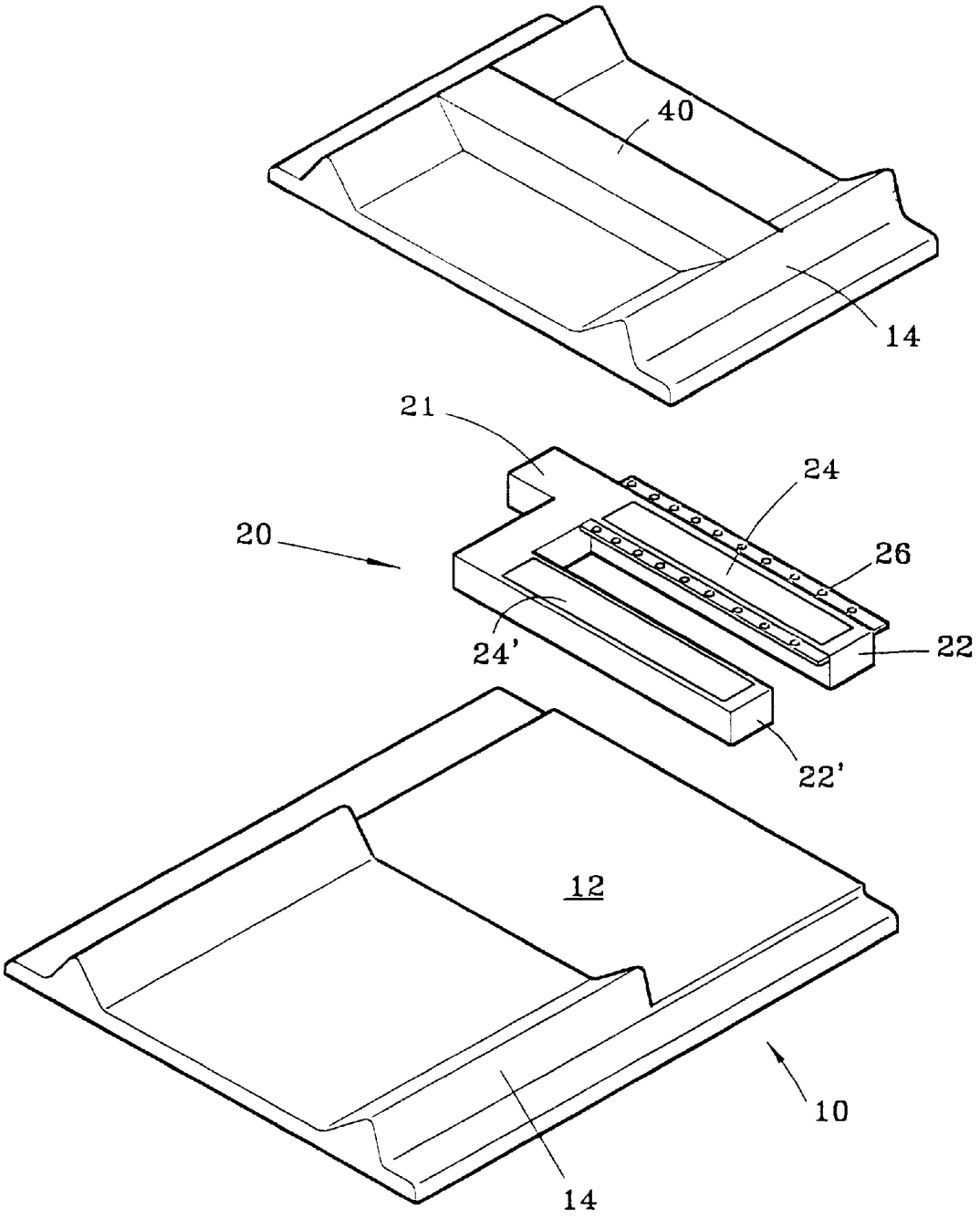
FIG. 3 is an exploded perspective view illustrating the construction of a refrigeration compartment door in accordance with the first embodiment of the present invention.

FIGS. 3 to 6 are views illustrating the construction of a refrigeration compartment door for refrigerators in accordance with the first embodiment of the present invention.

As shown in the drawings, a main body 10 of the refrigeration compartment door comprises a steel plate (not shown), insulating layer 12 and door liner 14. That is, the steel plate is mounted on the front portion of the door, while the door liner 14 is provided in the interior of the door. Also, a door duct 20 is mounted in the interior of the insulating layer 12.

Figure 4:
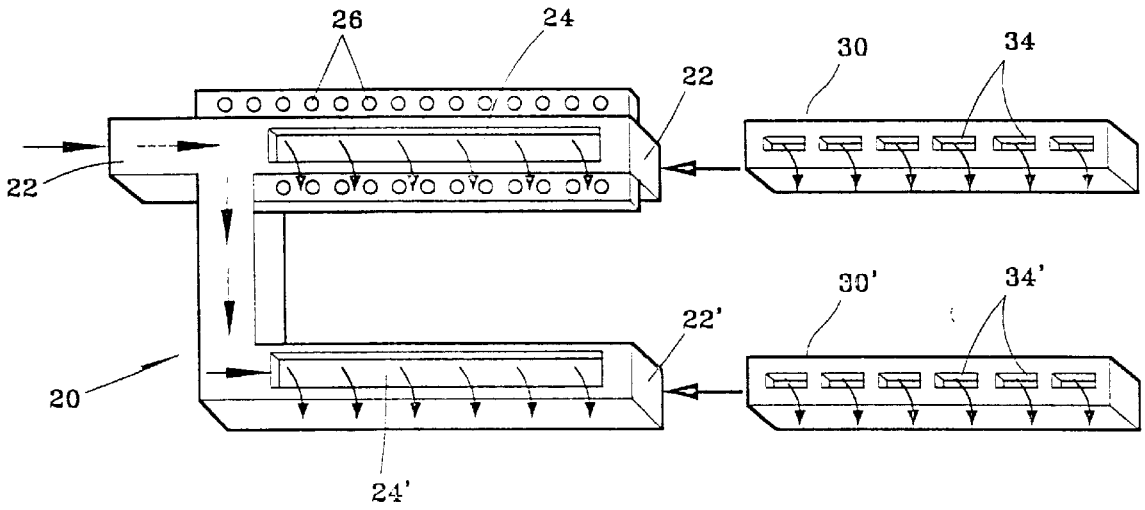
FIG. 4 is a perspective view showing a door duct of the refrigeration compartment door of FIG. 3.

As shown in FIG. 4, the door duct 20 includes one inlet portion 21 and two branch ducts 22 and 22'. That is, cool air, passing through the guide duct of the cabinet of a refrigerator, is introduced into the door duct 20 through the inlet portion 21. Also, the branch ducts 22 and 22' are branched from the inlet portion 21 in such a manner that they are horizontally arrayed with each other. Alternatively, three more branch ducts may be formed when necessary.

In addition, hollow parts 24 and 24' are, respectively formed in the branch ducts 22 and 22' and open at the front portion in order to allow the cool air to be discharged into the interior of the refrigeration compartment. A plurality of fitting holes 26 are formed on the upper and lower portions of the branch ducts 22 and 22', respectively. For convenience' sake, the fitting holes 26, formed on the upper and lower portions of the branch duct 22', are not illustrated in the drawings.

Figure 6:
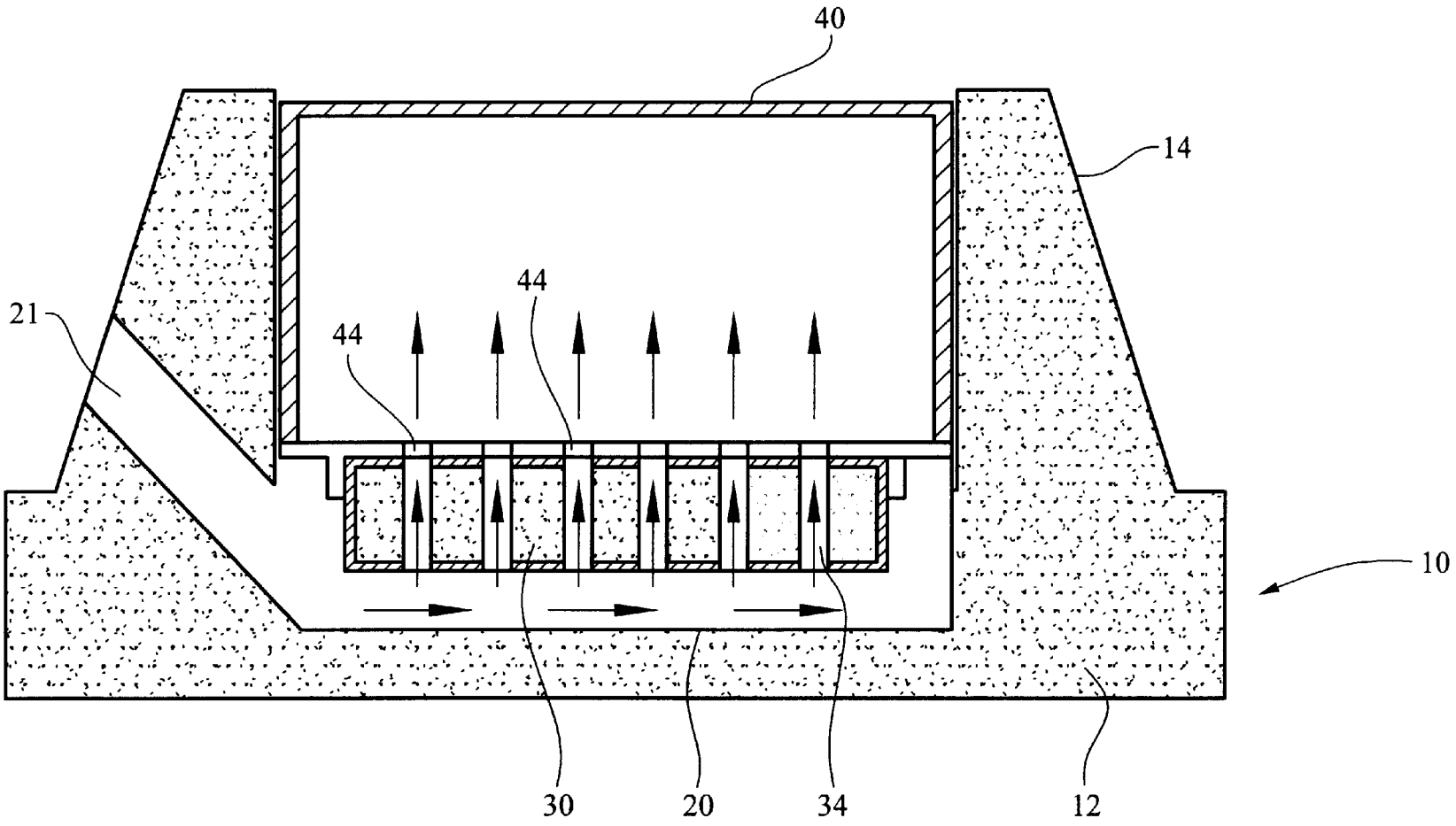
FIG. 6 is a sectional view illustrating the construction of the refrigeration compartment door of FIG. 3.

Two insulating members 30 and 30' are inserted into the hollow parts 24 and 24', respectively. Each of the insulating members 30 and 30' has a plurality of first discharging holes 34 at its front portion in order to communicate the branch ducts 22 and 22' with the refrigeration compartment, thus allowing the cool air to be easily introduced into the interior of the refrigeration compartment. As shown in FIG. 6, the front portion of the insulating members 30 and 30' are located at the hollow parts 24 and 24' of the branch ducts 22 and 22', respectively.

Figure 5:
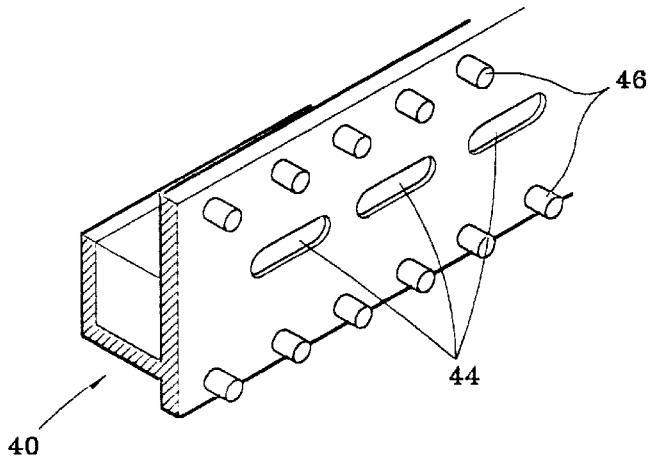
FIG. 5 is a perspective view showing a door basket of the refrigeration compartment door of FIG. 3.

FIG. 5 is a perspective view illustrating the construction of a door basket in accordance with this invention.

As shown in FIG. 5, a door basket 40 is provided in the interior of the liner 14 of the main body 10. The door basket 40 has a plurality of second discharging holes 44 which communicate with the first discharging holes 34 of the insulating members 30 and 30', respectively. In addition, a plurality of pins 46 are formed on the rear wall of the door basket 40. The door basket 40 is mounted to the main body 10 of the refrigeration compartment door in such a manner that the pins 46 are inserted into the fitting holes 26 of the branch ducts 22 and 22', respectively. Alternatively, the door may be provided with as many baskets as the number of branch ducts.

The fabrication of the refrigeration compartment door in accordance with this invention is described below.

The door duct 20 is mounted in the interior of the main body 10 of the door prior to the foaming of the insulating layer 12. Thereafter, the door basket 40 is mounted to the branch ducts 22 and 22'. In this case, the door basket 40 is correctly mounted to the main body 10 as the pins 46 of the door basket 40 are inserted into the fitting holes 26 of the branch duct 22. Thus, the first discharging holes 34 of the insulating members 30 and 30' communicate with the second discharging holes 44 of the door basket 40.

The circulation of the cool air of the refrigerator is described below in conjunction with FIG. 6.

The cool air is introduced to the inlet portion 21 of the door duct 20 passing through the guide duct provided in the cabinet of the refrigerator. Thereafter, the cool air is introduced into the branch ducts 22 and 22' and is discharged from the door to the rear portion of the refrigeration compartment passing through the second discharging holes 34 of the insulating members 30 and 30', and the first discharging holes 44 of the door basket 40.

At this time, since the cool air is discharged into the refrigeration compartment passing through the two branch ducts 22 and 22', the discharging range of the cool air is relatively wide. Also, the heat of the refrigeration compartment, having a relatively high temperature, is not transmitted to the branch ducts 22 and 22', having a relatively low temperature, due to the insulating members 30 and 30'. Thus, dewdrops and ice are not formed at the second discharging holes 44 of the door basket 40.

Figure 7:
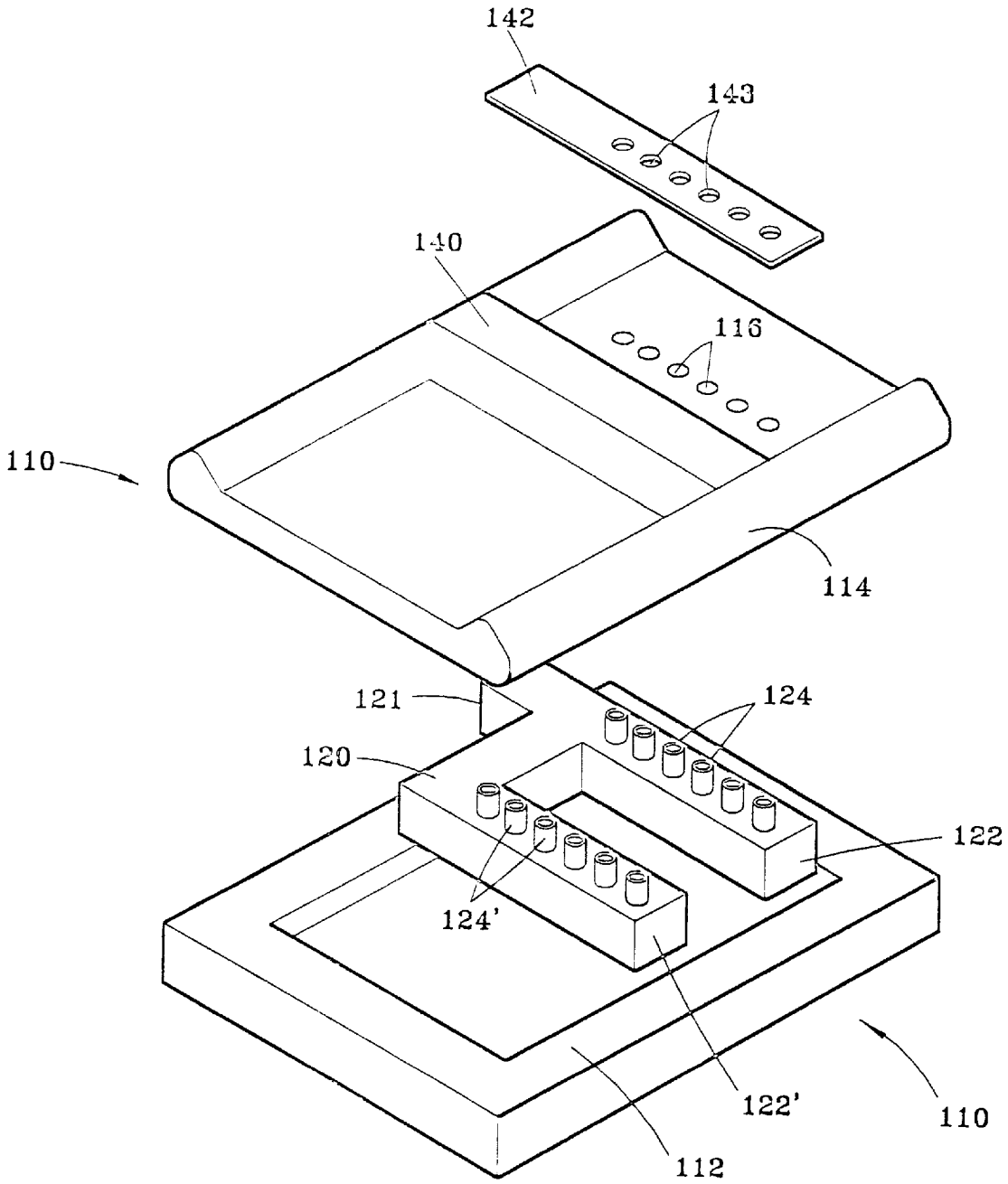
FIG. 7 is an exploded perspective view illustrating the construction of a refrigeration compartment door in accordance with the second embodiment of the present invention.
Figure 8:
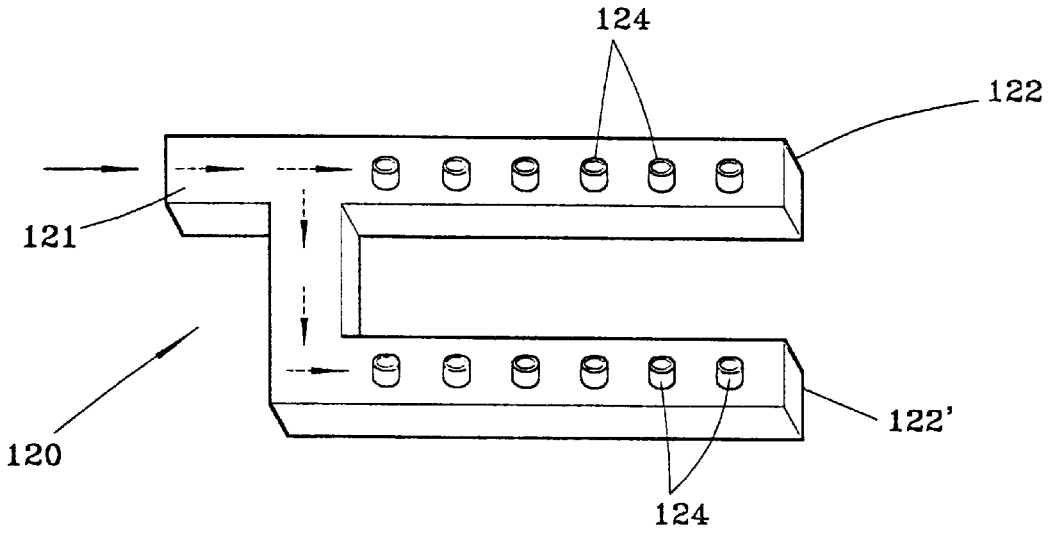
FIG. 8 is a perspective view showing a door duct of the refrigeration compartment door of FIG. 7.
Figure 9:
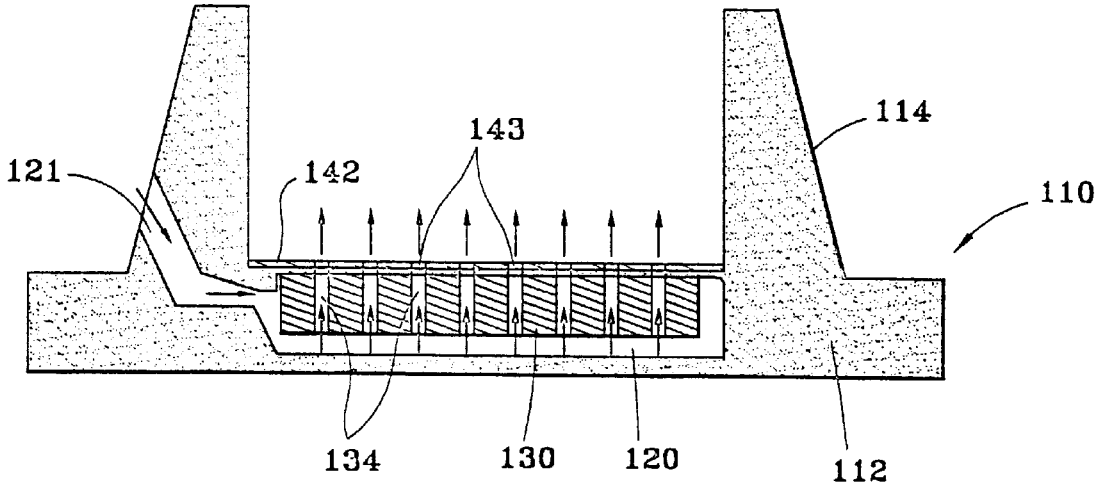
FIG. 9 is a sectional view illustrating the construction of the refrigeration compartment door of FIG. 7.

FIGS. 7 to 9 are views illustrating the construction of a refrigeration compartment door for refrigerators in accordance with the second embodiment of the present invention.

In the second embodiment, the construction elements of the refrigeration compartment door are similar to the above-mentioned door illustrated in FIGS. 3 to 6. That is, a main body 110 of the door comprises a steel plate (not shown), insulating layer 112 and door liner 114. Also, the insulating layer 112 is provided in the interior of the main body 110, while a door duct 120 is mounted in the interior of the insulating layer 112. For convenience' sake, the door liner 114 is separated from the main body 110 as shown in FIG. 7, but the door liner 114 is integrally formed to the main body 110.

As shown in FIG. 8, the door duct 120 includes one inlet portion 121 and two branch ducts 122 and 122'. Of course, three more branch ducts may be formed according to the discharging range of cool air. In addition, a plurality of discharging tubes 124 and 124' are protrudently mounted to the branch ducts 22 and 22' in order to be inserted into a plurality of inserting holes 116 formed on the door liner 114 of the main body 110. In this case, the inserting holes 116 are preferably located near a basket 140 of the refrigeration compartment door. Also, since the discharging tubes 124 and 124' are protrudently formed, the door duct 120 is correctly located at the door liner 114 as the tubes 124 and 124' are inserted into the inserting holes 116.

Of course, it should be understood that the construction plan of the branch ducts 122 and 122' is not limited to the construction plan shown in FIG. 8 but may be freely changed without affecting the functioning of this invention. That is, the cool air is not discharged from one specified portion of the inner surface of door but may be discharged from any portion of the inner surface of the door. For example, a pair of branch ducts may be vertically arrayed with each other and may be connected to the interior of the door liner.

In the same manner as described for the insulating member 30 in accordance with the first embodiment of this invention, an insulating member 130 is provided in the interior of the branch ducts 122 and 122', respectively. The insulating member 130 has a plurality of first discharging holes 134 at its front portion in such a manner that the discharging holes 134 are communicated with the discharging tubes 124 of the branch ducts 22 as shown in FIG. 9. In addition, a wide temperature difference between the interior of the refrigeration compartment and the interior of the door ducts 120 and 122' is reduced by the insulating member 130, thus effectively preventing dewdrops and ice from being formed.

A front panel 142, having a plurality of second discharging holes 143, is mounted to the door liner 114 in such a manner that the discharging tubes 124 are inserted into the second discharging holes 143 through the inserting holes 116 of the door liner 114. As a result, the front panel 142 is completely mounted to the main body 110 of the door, thus improving the appearance of the door liner 114.

As shown in FIG. 7, a door basket 140 is mounted to the door liner 114. Of course, the door basket 140 may be integrally or separately formed to the door liner 114. Preferably, the door basket 140 is located at a position corresponding to the discharging tubes 124, thus allowing the cool air to be easily discharged into the door basket 140.

The fabrication of the refrigeration compartment door in accordance with the second embodiment of this invention is described below.

The discharging tubes 124 of the door duct 120 are inserted into the inserting holes 116 of the door liner 114. Thereafter, the door liner 114 is mounted in the interior of the main body 110 of the door prior to the foaming of the insulating layer 112. Where the door basket 140 is not integrated with the door liner 114, the door basket 140 is mounted to the door liner 114. Thereafter, the front panel 142 is mounted to the front ends of the discharging tubes 124.

The circulation of the cool air of the refrigerator is described below in conjunction with FIG. 9.

The cool air is introduced into the inlet portion 121 of the door duct 120 passing through the guide duct provided in the cabinet of the refrigerator. Thereafter, the cool air is separately introduced into the branch ducts 122 and 122', respectively, and is discharged from the door to the rear portion of the refrigeration compartment passing through the first discharging holes 134 of the insulating member 130 and the discharging tubes 124.

At this time, since the cool air is discharged passing through the two branch ducts 122 and 122', the discharging range of the cool air is relatively wide. Of course, when the number of the branch ducts is increased to two more, the cool air may be sufficiently discharged to all sides of the refrigeration compartment. In addition, a wide temperature difference between the interior of the refrigeration compartment and the interior of the door duct 120 is reduced by the insulating member 130, thus effectively preventing dewdrops and ice from being formed.

As mentioned above, the refrigeration compartment door for refrigerators of this invention is provided with a door duct at a door basket capable of guiding cool air to the refrigeration compartment, thus uniforming the inner temperature of the refrigeration compartment.

In addition, the door duct of this invention includes at least two more branch ducts having an insulating member therein, thus preventing the dewdrops and ice from being formed and allowing the cool air to be smoothly discharged into the refrigeration compartment.

Furthermore, the door duct is connected to the door basket in such manner that the discharging tubes of the door duct are inserted into the inserting holes of the door liner, thus allowing the fabrication of the door to be correctly and easily carried out.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigeration compartment door for refrigerators, comprising:

a main body including an insulating layer therein;

a door duct provided in said insulating layer and having at least two more branch ducts, so cool air, introduced from a cabinet of a refrigerator to said door duct, is separately introduced into the branch ducts; and an insulating member mounted to said door duct and having a plurality of first discharging holes in order to allow the cool air to be discharged into the interior of the refrigeration compartment passing through said door duct, so a wide temperature difference between the interior of the refrigeration compartment and said door duct is reduced by said insulating member.

2. The refrigeration compartment door as claimed in claim 1, wherein a basket, having a plurality of second discharging holes, is provided at a front portion of said door duct in such a manner that the second discharging holes are communicated with the first discharging holes of said insulating member.

3. The refrigeration compartment door as claimed in claim 1, wherein a plurality of discharging tubes are protrudently formed on said door duct, so the cool air, passing through the first discharging holes of said insulating member, is discharged into the interior of the refrigeration compartment through the discharging tubes.

4. The refrigeration compartment door as claimed in claim 3, wherein a front panel, having a plurality of third discharging holes, is mounted to a front portion of said door duct in such a manner that said discharging tubes are inserted into the third discharging holes.

* * * * *